United States Patent [19]

Merrill et al.

[11] 4,273,849

[45] Jun. 16, 1981

[54] METHOD OF USING LIQUID ELECTROGRAPHIC DEVELOPERS CONTAINING POLYMERIC QUATERNARY SALTS

[75] Inventors: Stewart H. Merrill; Alec N. Mutz; Frederick A. Stahly, all of Rochester, N.Y.

[73] Assignee: Eastman Kodak Company, Rochester, N.Y.

[21] Appl. No.: 135,757

[22] Filed: Mar. 31, 1980

Related U.S. Application Data

[60] Division of Ser. No. 43,860, May 29, 1979, Pat. No. 4,229,513, which is a continuation-in-part of Ser. No. 824,132, Aug. 12, 1977, abandoned.

[30] Foreign Application Priority Data

Aug. 11, 1978 [GB] United Kingdom ..... 33132/78

[51] Int. Cl.[3] ..... G03G 13/10

[52] U.S. Cl. ..... 430/119

[58] Field of Search ..... 430/113, 114, 115, 119

[56] References Cited

U.S. PATENT DOCUMENTS

| | | | |
|---|---|---|---|
| 3,523,906 | 8/1970 | Vrancken et al. | 430/114 |
| 3,535,244 | 10/1970 | Zabiak | 430/114 |
| 3,788,995 | 1/1974 | Stahly et al. | 430/114 |
| 3,977,983 | 8/1976 | Tsuneda | 430/114 |
| 3,985,663 | 10/1976 | Lu et al. | 430/115 |
| 4,221,856 | 9/1980 | Lu | 430/115 X |

FOREIGN PATENT DOCUMENTS

| | | |
|---|---|---|
| 50-99330 | 8/1975 | Japan . |
| 51-5787 | 2/1976 | Japan . |
| 1233869 | 6/1971 | United Kingdom . |

*Primary Examiner*—Roland E. Martin, Jr.
*Attorney, Agent, or Firm*—William T. French

[57] ABSTRACT

A negatively charged liquid electrographic developer comprising an electrically insulating carrier liquid such as a paraffinic hydrocarbon fraction, having stably dispersed therein (a) a halogenated polymer, such as chlorinated polyethylene, and having dissolved therein (b) a copolymer of a quaternary ammonium salt monomer and a solubilizing monomer and (c) a copolymer of a polar monomer and a solubilizing monomer.

11 Claims, No Drawings

METHOD OF USING LIQUID ELECTROGRAPHIC DEVELOPERS CONTAINING POLYMERIC QUATERNARY SALTS

CROSS REFERENCE TO RELATED APPLICATIONS

This is a division of application Ser. No. 043,860, filed May 29, 1979, now U.S. Pat. No. 4,229,513, which is a continuation-in-part application of U.S. application Ser. No. 824,132 filed Aug. 12, 1977, now abandoned.

FIELD OF THE INVENTION

This invention relates to electrography and more particularly to novel liquid developers and their use in the development of electrostatic charge patterns.

BACKGROUND OF THE INVENTION

Both dry and liquid developers are used for the development of latent electrostatic charge images. Dry developers cause some problems. Dusting is one of them. Another is the difficulty of controlling distribution of the dry toner powder on the latent image. A further problem is that the rather large particle size of the ground toner particles limits the fineness of the image resolution.

Liquid developers as described, for example, in Metcalfe et al, U.S. Pat. No. 2,907,674, and as widely used in office copying machines that copy documents on zinc oxide coated paper, avoid or reduce certain of the problems of dry developers.

Liquid electrographic developers are a dispersion of toner particles, usually of a pigment and a binder resin, in an electrically-insulating carrier liquid such as a volatile hydrocarbon fraction. The binder resin serves to bind the pigment to the copy paper on which the latent electrostatic image is developed. The developer can also contain a stabilizer additive to maintain a stable dispersion of the toner particles, although in practice many so-called "stabilized" liquid developers prove unstable after a period of time, especially when the initial toner concentrate is diluted with carrier liquid to form a working strength developer. Liquid developers also often contain a charge control agent to maintain a constant charge level.

Stabilizers for liquid developers are described, for example, in York, U.S. Pat. No. 2,899,335 and U.K. Pat. No. 1,065,796. Charge control agents, including certain quaternary ammonium salts, are disclosed in Beyer, U.S. Pat. No. 3,417,019 and Tsuneda, U.S. Pat. No. 3,977,983 for liquid developers and in Jadwin et al U.S. Pat. No. 3,893,935 for dry developers.

For reasons not fully understood, most binder resins develop a positive charge when dispersed in an insulating carrier liquid. Negatively charged developers are also needed, however. For instance, some electrographic microfilm reader-printers employ both a negatively charged and a positively charged liquid developer so that the user can switch from one to the other if he wishes to reverse the printing of the image.

Unfortunately, even the few binder resins that develop a negative charge have drawbacks. For instance, halogenated polymers offer promise as negatively charged binder resins but their use has been impeded by the difficulty of dispersing them stably in the usual electrically insulating carrier liquids.

SUMMARY OF THE INVENTION

In accordance with the present invention, we have found that stable liquid developers can be formed with these halogenated polymers by dispersing them in a carrier liquid in admixture with certain soluble copolymeric quaternary ammonium salts, which serve as dispersing agents, and with certain soluble polar addition copolymers, which serve as stabilizers. The resulting liquid developer of our invention is negatively charged and has excellent suspension and charge stability and produces images that do not smear, that have high image density and excellent resolution and low background density.

Our invention provides a negatively charged electrographic liquid developer comprising an electrically insulating carrier liquid having stably dispersed therein (1) a halogenated polymer, and having dissolved therein (2) a soluble copolymer of a quaternary ammonium salt monomer and a solubilizing monomer, said copolymer being free of cations of alkali metals and alkaline earth metals, and (3) a soluble copolymer of an acrylic polar monomer and a solubilizing monomer, the amounts of solubilizing monomer units in each copolymer being sufficient to make the copolymer soluble in the carrier liquid.

DETAILED DESCRIPTION OF THE INVENTION

(a) Definitions

The description of the invention and the appended claims use certain terms that we wish to define. Thus, we use the term "polymer" in its generic sense to include not only homopolymers but also copolymers of two or more monomers.

When we speak of soluble polymers and solubilizing monomers we mean soluble in the electrically insulating carrier liquid, which normally is a non-polar hydrocarbon liquid. Also, we define solubility by the following test: Four grams of polymer are mixed with carrier liquid in a Waring blender operating within the range of 10,000 to 18,000 rpm. The mixture is centrifuged at 34,000 G forces for 60 minutes. The amount of polymer precipitated is then measured. The polymer is considered soluble for the practice of our invention if at least about 3.3 grams of the original 4.0 gram quantity of polymer (82.5%) remain dissolved in the carrier liquid.

(b) Halogenated Polymers

The halogenated polymers that serve as negatively charged binder resins in our developers include, for example, halogenated polyethylene, halogenated polypropylene, halogenated paraffin wax, halogenated rubber, halogenated alkyd resins, halogenated polyesters such as polyesters of chlorendic anhydride or tetrachlorophthalic acid with glycols such as ethylene glycol, 1,4-butanediol or neopentyl glycol, polyvinylhalides, copolymers of vinyl halides, copolymers of vinyl halides and vinylidene halides with alkyl acrylates and methacrylates and the like. Useful halogenated polymers are disclosed in the patent to Fauser et al U.S. Pat. No. 3,507,794 of Apr. 21, 1970; the patent to Johnson, U.S. Pat. No. 3,105,821 of Oct. 1, 1963; and the patent to Mayer, U.S. Pat. No. 2,891,911 of June 23, 1959.

Although halogenated polymers in general can be used, chlorinated, fluorinated and brominated hydrocarbon polymers are the most useful as negatively charged binder resins. For best results the halogen content of the polymer should be at least about 25 weight percent and can be as high as about 85 weight percent, for a fully halogenated hydrocarbon polymer, although fluorinated polymers with as little as 10 weight percent fluorine are useful.

The most desirable binder resins are chlorinated poly α-olefins. Especially preferred are chlorinated homopolymers and copolymers of ethylene, propylene and 1-butene that contain at least about 40 weight percent chlorine. Suitable resins of this kind are disclosed in Contois et al U.S. Pat. No. 3,652,269 and Merrill et al U.S. Pat. No. 3,738,833 as binders for photoconductors.

The halogenated polymers can be prepared in known manner, for example, by treating a solution of hydrocarbon polymer with halogen under known reaction conditions of temperature, pressure and catalysis until the desired halogen content is reached. They can also be prepared by addition polymerization of halogenated monomers such as vinyl chloride or vinylidene chloride.

(c) Quaternary Ammonium Salt Polymers

The soluble polymeric quaternary ammonium salt as present in the compositions of our invention is free of cations of alkali metals and alkaline earth metals. By this we mean not only that the polymer prior to incorporation in the developer contains no such metals, but also that if the developer contains cations of such metals from any other sources, the polymeric quaternary ammonium salt is free of sites for ionic attachment of such cations. Preferably the polymeric quaternary ammonium salt is a polymer of one or more monomers selected from the following:

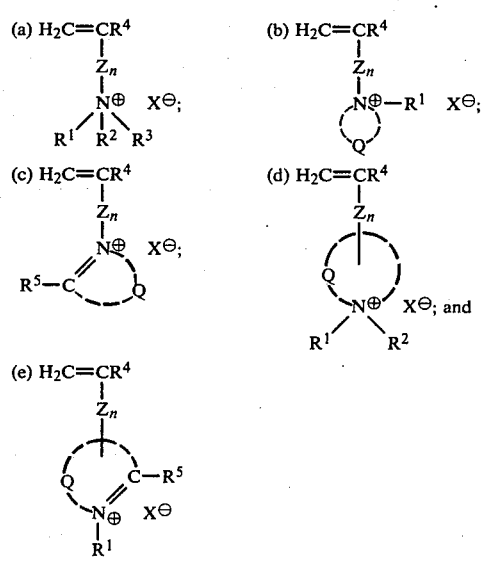

wherein:

$R^1$, $R^2$ and $R^3$ are alkyl or aryl radicals having 1 to 30 carbon atoms:

$R^4$ and $R^5$ are hydrogen or lower alkyl having 1 to 4 carbon atoms;

Q represents the atoms necessary to complete a 5 or 6-membered heterocyclic ring;

$X^-$ is an anion; and

Z is selected from the group consisting of $—R^6—$,

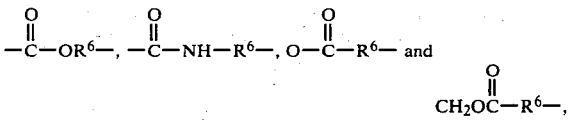

where $R^6$ is alkylene, arylene or arylenealkylene (e.g., benzylene) having 1 to 20 carbon atoms, and n is 0 or 1.

Preferably $R^1$ and $R^2$ are lower alkyl of from 1 to 4 carbon atoms, $R^3$ is alkyl of 1 to 20 carbon atoms, and the sum of $R^1$, $R^2$ and $R^3$ does not exceed 30 carbon atoms.

Examples of suitable quaternary ammonium salt monomers include:

methacryloyloxyethytrimethylammonium p-toluene sulfonate;

dimethyloctadecylvinylbenzylammonium chloride;

2-vinyl-N-methylpyridinium methyl sulfate;

N-methyl-N-methacryloyloxyethylpiperidinium bromide;

N-methacryloyloxyethylpyridinium nitrate.

Other heterocyclic ammonium salts analogous to these pyridinium and piperidinium salts are also useful, e.g., morpholinium and thiamorpholinium salts.

Preferred examples of such quaternary ammonium salt polymers include poly(vinyltoluene-co-lauryl methacrylate-co-methacryloyloxyethyltrimethylammonium p-toluene sulfonate) and poly(vinyltoluene-co-lauryl methacrylate-co-dimethyloctadecylvinylbenzylammonium chloride).

The polymeric quaternary ammonium salts can be prepared by copolymerizing quaternary ammonium salt monomers as described above with a "soluble moiety" of the type described in Stahly et al U.S. Pat. No. 3,849,165, which we refer to herein as a "solubilizing monomer." They can also be obtained by quaternizing the selected copolymer after it has been prepared by copolymerizing a solubilizing monomer with a monomer containing a teritary amino group. Any solubilizing monomer can be employed as long as the resulting copolymer is soluble in the carrier liquid.

Representative solubilizing monomers include the following: alkylstyrenes and alkoxystyrenes having about 3 to about 10 carbon atoms in the alkyl group; alkyl acrylates and methacrylates having about 8 to about 22 carbon atoms in the alkyl group; vinyl alkyl ethers having about 8 to about 22 carbon atoms in the alkyl group; and vinyl esters of alkanoic acids having about 6 to about 22 carbon atoms in the alkyl group.

Preferred solubilizing monomers include:

(a) alkylstyrenes having from about 4 to about 10 carbon atoms in the alkyl group;

(b) alkyl acrylates and methacrylates having from about 12 to about 22 carbon atoms in the alkyl group;

(c) vinyl esters of aliphatic acids having from about 10 to about 22 carbon atoms in the alkyl group; and, mixtures thereof.

Specific solubilizing monomers which can be so used include: t-butylstyrene, 4 pentylstyrene, 4-hexylstyrene, 4-octylstyrene, p-amyloxystyrene, lauryl acrylate, lauryl methacrylate, hexadecyl methacrylate, octadecyl methacrylate, eicosyl acrylate, docosyl methacrylate, vinyl caprate, vinyl laurate, vinyl palmitate, vinyl stearate, vinyl eicosate, and vinyl docosate.

We have found that if the quaternary ammonium salt copolymer contains at least about 35 weight percent of recurring units derived from the solubilizing monomer the copolymer will form a substantially stable dispersion in a typical carrier liquid. Preferably the quaternary ammonium salt monomeric units do not exceed about 20 weight percent of the polymer. If no third type of monomer is used, the solubilizing monomer preferably forms at least about 84 weight percent of the polymer.

The quaternary ammonium salt copolymers can also contain units derived from one or more additional monomers. For example, when a quaternary ammonium salt monomer such as vinylbenzyloctadecyldimethylammonium chloride is copolymerized only with a solubilizing monomer of certain types, such as lauryl methacrylate, the resulting copolymer may be a soft amorphous mass which, although useful in liquid developers, is difficult to recover from the reaction mixture. If, however, the two monomers are copolymerized with one or more additional monomers of the type referred to by Stahly et al, U.S. Pat. No. 3,849,165 as "insoluble moieties," and which we call "insolubilizing monomers," the resulting copolymer is harder and can be recovered conveniently as a solid precipitate from the polymerization reaction mixture.

Some solubilizing monomers, of which t-butyl styrene is an example, are adequate alone to produce a hard, precipitable copolymer with the quaternary ammonium salt monomer. When they are used no advantages in product recovery are obtained by using an insolubilizing monomer. If desired, however, the quaternary ammonium salt copolymers can also contain units derived from the third type of monomers, i.e., the insolubilizing monomers, and when we refer to any copolymer used in our developers as being a copolymer of a solubilizing monomer and, for example, a quaternary ammonium salt monomer, we mean to include copolymers which are derived not only from the recited two monomers but also from one or more other monomers such as an insolubilizing monomer. Suitable insolubilizing monomers include:

(a) styrene, methylstyrene, methoxystyrene and halogenated styrene;

(b) alkyl acrylates having from about 1 to about 4 carbon atoms in the alkyl group;

(c) alkyl methacrylates having from 1 to about 4 carbon atoms in the alkyl group;

(d) vinyl alkyl ethers having from 1 to about 4 carbon atoms in the alkyl group; and (e) vinyl esters of alkanoic acids having from about 1 to about 4 carbon atoms in the alkyl group; and mixtures thereof.

Preferred insolubilizing monomers include: styrene, vinyl toluene, ethyl acrylate, methyl acrylate, butyl acrylate, ethyl methacrylate, propyl methacrylate, butyl methacrylate, vinyl acetate, vinyl propionate, vinyl butyrate and mixtures thereof.

Quaternary ammonium salt polymers useful in the liquid developers of this invention typically have an inherent viscosity in the range from about 0.1 to about 0.8. The determination is made at a concentration of 0.25 grams of polymer in 100 ml. of chloroform at a temperature of 25° C. The resultant polymers contain recurring units derived from one or more solubilizing monomers, from one or more quaternary ammonium salt monomers and, if desired, from one or more insolubilizing monomers. A typical quaternary ammonium salt copolymer used in the liquid developers of the invention contains from about 35 to about 68.5 weight percent of solubilizing monomer units, from about 30 to about 63.5 weight percent insolubilizing monomer units and from about 1.5 to about 20 weight percent of quaternary ammonium salt monomer units.

The solubility of the quaternary ammonium salt copolymer in the carrier liquid can be controlled by adjusting the amount of solubilizing monomer and of any insolubilizing monomer that may be used. If the solubilizing monomer has a very long alkyl group, rendering a polymer containing it very soluble in hydrocarbon carrier liquids, the insolubilizing monomer may have a relatively short alkyl group. On the other hand, a relatively short alkyl group on the solubilizing monomer requires a somewhat longer alkyl group on the insolubilizing monomer if one is used. As previously indicated, useful soluble copolymers are dispersible in the carrier liquid to the extent that when 4.0 grams of polymer are dispersed in one liter of carrier liquid, at least about 3.3 grams remain dispersed after centrifuging the mixture at 34,000 G forces for 60 minutes.

The relative amount of quaternary ammonium salt monomer can be varied to provide polymers having different charge properties when incorporated into a liquid developer. Mechanical properties such as abrasion resistance, and fixability of the resultant toner image can also be adjusted by balancing the ratio of the monomers in each copolymer.

The soluble quaternary ammonium salt copolymers are effective dispersing agents for the halogenated polymeric binder. They also increase the negative charge of the developer composition and serve as charge control agents. However, dispersions containing only the halogenated polymer and the quaternary ammonium salt polymer are not sufficiently stable, especially when diluted with an isoparaffic hydrocarbon carrier liquid in working strength developer composition.

(d) Polar Copolymers

Further in accordance with our invention, we have discovered that by incorporating a soluble polar addition copolymer of the type disclosed by Stahly et al, U.S. Pat. No. 3,849,165 with the polymeric quaternary ammonium salt and the halogenated polymer we obtain a stable dispersion in the carrier liquid which, as a developer composition, has the desirable properties previously mentioned.

The soluble polar copolymer is an addition copolymer of a polar monomer and at least one solubilizing monomer. The amount of polar monomer is at least about $1.5\times10^{-4}$ moles/gm of copolymer.

Monomers for addition copolymerizing with the polar monomer to obtain a soluble polar copolymer are the solubilizing monomers previously described and, if desired, insolubilizing monomers also previously mentioned, both of which are described by Stahly et al, U.S. Pat. No. 3,849,165. The relative amounts of the comonomers are selected to produce a polar addition copolymer of the desired solubility, as described above with respect to the quaternary ammonium salt copolymers.

Suitable polar monomers include sulfoalkyl acrylates and methacrylates, metal salts of sulfoalkyl acrylates and methacrylates, and amine salts of sulfoalkyl acrylates and methacrylates. Preferably the sulfoalkyl groups contain from 1 to about 4 carbon atoms. Also suitable are metal salts and amine salts of acrylic and methacrylic acids, and of vinylbenzoic acid, vinylphenylacetic acid, 9(10)-acrylamidostearic acid, monoalkylphthalic acid, and styrenesulfonic acid, the metals of said salts being from Groups I, IIa, IIb and VIII of the Periodic Table, and mixtures thereof. Partial metal and amine salts of the esters and acids can be used, as can mixtures of the complete or partial salts with the salt-free form of the esters and acids.

The preferred polar addition monomers are acrylic monomers. In this sense we use the term "acrylic" broadly to include methacrylic and to include salts and esters of such acrylic acids.

Specific examples of such acrylic polar monomers include: sulfoethyl methacrylate; sulfoethyl acrylate; sulfopropyl methacrylate; sulfobutyl methacrylate; sulfoethyl methacrylate, sodium salt; sulfoethyl methacrylate, partial sodium salt; sulfopropyl methacrylate, sodium salt; sulfobutyl methacrylate, potassium salt; sulfoethyl methacrylate, lithium salt; sulfoethyl methacrylate, copper salt; sulfopropyl methacrylate, dimethylammonium salt; sulfoethyl methacrylate diethylammonium salt; sulfomethyl acrylate, dimethylammonium salt; sodium methacrylate; sodium acrylate; lithium methacrylate; potassium acrylate; barium methacrylate; zinc methacrylate; cobalt methacrylate; ferrous acrylate; magnesium methacrylate; zinc acrylate and mixtures thereof.

(e) The Developer Formulation

The liquid electrographic developers of this invention contain from about 0.01% to about 5% by weight of soluble polar copolymer, from about 0.01% to about 5% by weight of quaternary ammonium salt copolymer, and from 0.01% to about 5% by weight of halogenated hydrocarbon polymer. Preferred developers contain from about 0.02% to about 0.5% by weight of the soluble acrylic polar copolymer, from about 0.02% to about 0.5% by weight quaternary ammonium salt copolymer, and from about 0.02% to about 0.5% by weight halogenated hydrocarbon polymer.

A toner concentrate, from which the liquid developer is prepared, can be obtained by solvent milling. The stabilizer polymer, with a solvent such as a light aromatic hydrocarbon liquid, is ballmilled with pigments for several days, e.g., up to about 15 days. The other components are then added and mixed to obtain the concentrate. Alternatively, a viscous solution of the polymers is placed on chilled compounding rolls (e.g., 5° to 10° C.) and blended with pigments and other additives. The pigment can comprise from about 200 to about 10% of the weight of the polymers.

Liquid developers are made by dispersing the toner concentrate in an electrically insulating carrier liquid. The liquid has a low dielectric constant and a very high electrical resistance such that it will not disturb or destroy the electrostatic charge pattern being developed. Carrier liquids should have a dielectric constant of less than about 3, should have a volume resistivity greater than about $10^{10}$ ohm-cm and should be chemically stable. Suitable carrier liquids include halogenated hydrocarbon solvents, for example, fluorinated lower alkanes, such as trichlorotrifluoroethane. Hydrocarbon solvents are useful, such as isoparaffinic hydrocarbons having a boiling range of from about 145° C. to about 185° C., such as Isopar G (Exxon Corporation) or cyclohydrocarbons such as cyclohexane. Additional carrier liquids which may be useful in certain situations include polysiloxanes, odorless mineral spirits, octane, etc.

Although it is possible to use the described copolymers to prepare liquid developers without further addenda, as when a colorless image is desired, it is customary to add a colorant to give the image optical density. Colorants can be selected from a variety of dyes and pigments. Carbon black is a preferred colorant but virtually any of the compounds in the "Color Index," Second Edition, 1956, Vols. I and II, may, in principle, be used. Included among the vast number of useful colorants would be such materials as Hansa Yello G (C.I. 11680), Nigrosine Spirit soluble (C.I. 50415), Chromogen Black ETOO (C.I. 14645), Rhodamine B (C.I. 45170), Solvent Black 3 (C.I. 26150), Fuchsine N (C.I. 42510), C.I. Basic Blue 9 (C.I. 52015), etc. Another useful class of colorants is comprised of nigrosine salts of mono- and difunctional organic acids having from about 2 to about 20 carbon atoms such as chloroacetic acid, stearic acid, sebacic acid, lauric acid, azelaic acid, adipic acid, abietic acid and the like. Nigrosine salts of this type are disclosed in Olson, U.S. Pat. No. 3,647,696 issued Mar. 7, 1972.

Other colorants include salts of water-soluble acid dyes, e.g., the metal, alkali metal and ammonium salts of dyes having sulfonic and/or carboxylic acid groups. Examples include the lead salt of copper phthalocyanine tetrasulfonic acid and the magnesium salt of 1-(p-sulfophenyl-3-phenyl)-4-(2.5-dichloro-4-sulfophenylazo)-5-pyrazolone. See Chechak, U.S. Pat. No. 3,770,638, issued Nov. 6, 1973. Particularly useful are pigments prepared from the reaction of a strongly acid dye with a strongly basic dye to form a highly insoluble precipitate having essentially no color dilution. See Chechak, British Pat. No. 1,343,790, issued Mar. 15, 1974.

The following examples are included for a further understanding of the invention. Unless otherwise indicated in the examples all percentages are by weight. The numbers immediately following the name of a copolymer indicate the percent by weight of the respective monomers in that copolymer. For instance, poly(-vinyltoluene-co-lauryl methacrylate-co-dimethyloctadecylvinylbenzyl-ammonium chloride) 50/48/2 consists of 50 weight percent vinyltoluene monomers, 48 weight percent lauryl methacrylate monomers, and 2 weight percent dimethyloctadecylvinylbenzylammonium chloride.

Quaternary ammonium salt polymers were prepared according to the following procedures.

Preparation 1

Preparation of poly(vinyltoluene-co-lauryl methacrylate-co-methacryloyloxyethyltrimethylammonium p-toluenesulfonate) 50/47/6

The methacryloyloxyethyltrimethylammonium p-toluene sulfonate monomer was made by adding an equimolar amount of methyl p-toluene sulfonate to a 15% solution of dimethylaminoethyl methacrylate in acetone with a small amount of hydroquinone. The mixture was warmed for several minutes at 50° C. Chilling induced crystallization of the product. Recrystallization from acetone at 5° C. gave material which melted at 126°-128° C. (corr). Anal. Calc'd for $C_{16}H_{25}NO_5S$: C, 56.0; H, 7.3; N, 4.1. Found: C, 55.7; H, 7.3; N, 4.1.

The terpolymer was made by flushing with nitrogen a solution containing 25 grams of vinyltoluene (mixed m- and p-isomers), 23.5 grams of lauryl methacrylate, 3 grams of methacryloyloxy ethyltrimethylammonium p-toluene sulfonate, 1 gram of azobisisobutyronitrile, 50 milliliters of dimethylfomanide, and 40 milliliters of dioxane, and heating at 60° C. for 24 hours. The polymer solution was poured into rapidly stirred cold water to precipitate a soft, sticky product. The product was soaked for a day in fresh water. The polymer, wet with water, was dissolved in benzene, and the water removed by azeotropic distillation. The benzene was evaporated in air to give the product. The sulfur content of the polymer was 0.55% which corresponds to 5.9% methacryloyloxyethyltrimethylammonium p-toluenesulfonate.

Preparation 2

Preparation of poly[vinyltoluene-co-laurylmethacrylate-co-(vinylbenzyl)octadecyldimethylammonium chloride]50/48/2

The (vinylbenzyl)octadecyldimethylammonium chloride was made by heating equimolar quantities of vinylbenzyl chloride (mixed m- and p-isomers) and octadecyldimethylamine at reflux in 2-butanone for an hour in the presence of a small amount of t-butylpyrocatechol. A waxy solid crystallized when the mixture was chilled at 5° C.

Anal. Calc'd for $C_{29}H_{52}ClN$: Cl, 7.9.

Found: Cl, 7.9

The polymer was made in the manner of Preparation 1, but using (vinylbenzyl)octadecyldimethylammonium chloride as the quaternary salt.

Other quaternary ammonium salt-containing polymers can be made by the procedures described above except changing the starting materials.

EXAMPLE 1

A concentrate was prepared by dissolving 6 parts (by weight) of poly(vinyltoluene-co-laurylmethacrylate-co-lithium methacrylate-co-methacrylic acid) 56/40/3.6/0.4 (also called VT polymer) stabilizer in 88 parts by weight of Solvesso 100 aromatic hydrocarbon solvent (a product of Exxon Corp. containing xylene and other alkylated benzenes) and adding 6 parts by weight of Peerless 155 carbon black. The mixture was ballmilled for 15 days using $\frac{1}{8}$-inch steel balls.

A working liquid developer was obtained by adding to an aliquot of the concentrate to yield 0.7 grams/liter pigment content, chlorinated polyethylene binder (degree of chlorination 67%) and a polymeric ammonium salt solution containing 6 parts by weight of poly(vinyltoluene-co-laurylmethacrylate-co-methacryloyloxyethyltrimethylammonium p-toluenesulfonate) 50/48/2 dispersing agent in 88 parts by weight of Solvesso 100 solvent, to obtain 1/1/0.5/0.5 pigment-to-stabilizer-to-quaternary salt to binder ratio. The mixture was diluted to one liter with Isopar G isoparaffinic carrier liquid under ultrasonic shear.

The resultant developer had a particle size of $\leqq 1\mu$ was negatively charged, and provided good images in a conventional electrophotographic process on zinc oxide-coated paper.

EXAMPLE 2

A concentrate was prepared as in Example 1. A working liquid developer was prepared also as in Example 1, however, replacing the quaternary salt with poly(vinyltoluene-co-laurylmethacrylate-co-dimethyloctadecylvinylbenzylammonium chloride).

Results were similar to those in Example 1.

EXAMPLE 3

In order to compare liquid developers containing a polymer described in U.S. Pat. No. 3,977,983 with the liquid developers of the present invention a copolymer of stearyl methacrylate, dimethylaminoethyl methacrylate, and potassium methacrylate quaternized with methyl p-toluenesulfonate was prepared as described in Example 1 of U.S. Pat. No. 3,977,983.

A liquid developer concentrate was prepared comprising the polymer of the patent described above in Isopar G carrier liquid (7% solution) and Raven 1255 carbon black at a 1:1 ratio, followed by milling the concentrate for 15 days. A similar concentrate was prepared wherein poly(vinyltoluene-co-lauryl methacrylate-co-methacryloyloxyethyltrimethylammonium-p-toluenesulfonate) was substituted for the polymer of the patent. Working developers, at a pigment concentration of 0.7 g/l were prepared from the two concentrates by diluting the concentrates with Isopar G carrier liquid and their development characteristics were compared. The results were as follows:

The developer containing the polymer of the patent and the developer containing poly(vinyltoluene-co-lauryl methacrylate-co-methacryloyloxyethyltrimethylammonium chloride) exhibited similar properties such as fine particle size ($\leqq 1\mu$) and negative charge. The development rates with the developer containing the polymer of the patent were slightly slower than for the other developer. Developed image quality produced by each developer was poor because of low $D_{max}$, high $D_{min}$ and a tendency for the images to smear.

Next a complete working developer composition of the invention, containing poly(vinyltoluene-co-lauryl methacrylate-co-methacryloyloxyethyltrimethylammonium chloride) polymer, was compared with a developer which was otherwise the same except for containing a different ammonium salt polymer, namely, a polymer of U.S. Pat. No. 3,977,983. In each developer the ratio of pigment; VT polymer: chlorinated polyethylene:quaternary salt-containing polymer was 1:1:0.4:0.6. The following data were obtained:

| | Developer According to Present Invention | Developer Containing Polymer of U.S. 3,977,983 |
|---|---|---|
| Particle size | $\leqq 1\mu$ | $\leqq 1\mu$ |
| $D_{max}$ | 0.78 | 0.30 |
| $D_{min}$ | 0.18 | 0.19 |
| ΔDensity | 0.60 | 0.11 |

The invention has been described in detail with particular reference to certain preferred embodiments thereof, but it will be understood that variations and modifications can be effected within the spirit and scope of the invention.

We claim:

1. A process for developing a latent electrostatic charge image comprising forming said electrostatic charge image on an insulating electrographic element and by contacting it with a liquid developer comprising an electrically insulating carrier liquid having dispersed therein a soluble quaternary ammonium salt copolymer that is free of cations of alkali metals and alkaline earth metals, a soluble acrylic polar copolymer, and a halogenated polymer.

2. A process of claim 1 for developing a latent electrostatic charge image wherein said acrylic polar copolymer is derived from a polar monomer selected from the group consisting of: sulfoalkyl acrylates, sulfoalkyl methacrylates, metal salts of sulfoalkyl acrylates, metal salts of sulfoalkyl methacrylates, amine salts of sulfoalkyl acrylates, amine salts of sulfoalkyl methacrylates, metal salts of acrylic and methacrylic acids, and amine salts of acrylic and methacrylic acids.

3. A process of claim 1 for developing a latent electrostatic charge image wherein said quaternary ammonium salt copolymer is derived from a quaternary ammonium salt monomer selected from the group consisting of:

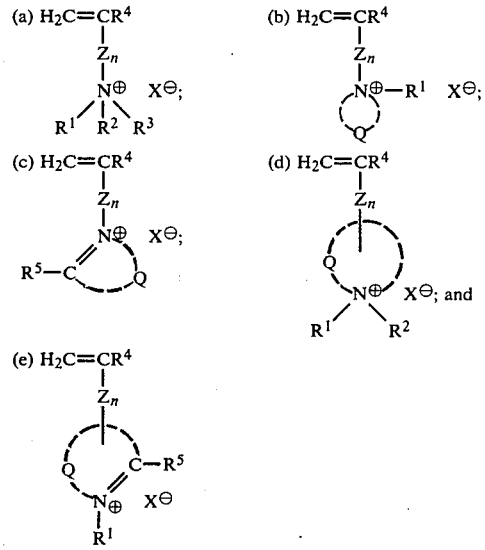

wherein:

$R^1$, $R^2$ and $R^3$ are alkyl or aryl radicals of 1 to 30 carbon atoms;

$R^4$ and $R^5$ are hydrogen or lower alkyl of 1 to 4 carbon atoms;

Q represents the atoms necessary to complete a 5 or 6-membered heterocyclic ring;

$X^-$ is an anion; and

Z is selected from the group consisting of $-R^6-$, $$\overset{O}{\overset{\|}{C}}-OR^6-,\ -\overset{O}{\overset{\|}{C}}-NH-R^6-,\ O-\overset{O}{\overset{\|}{C}}-R^6-\ \text{and}\ -CH_2O\overset{O}{\overset{\|}{C}}-R^6-,$$

where $R^6$ is alkylene, arylene or arylenealkylene of 1 to 20 carbon atoms, and n is 0 or 1.

4. A process of claim 1 for developing a latent electrostatic charge image wherein said halogenated polymer is selected from the group consisting of halogenated polyolefins, halogenated paraffin waxes and halogenated rubbers.

5. A process of claim 1 for developing a latent electrostatic charge image wherein said developer comprises from about 0.01 to about 5 weight percent of soluble acrylic polar copolymer, from about 0.01 to about 5 weight percent of soluble quaternary ammonium salt copolymer, and from about 0.01 to about 5 weight percent halogenated polymer.

6. A process for developing a latent electrostatic charge image comprising forming said electrostatic charge image on an insulating electrographic element and contacting it with a liquid developer comprising an electrically insulating carrier liquid having dispersed therein (1) a soluble acrylic polar copolymer of an acrylic polar monomer and at least one solubilizing monomer said acrylic polar monomer being selected from the group consisting of: sulfoalkyl acrylates, sulfoalkyl methacrylates, metal salts of sulfoalkyl acrylates, metal salts of sulfoalkyl methacrylates, amine salts of sulfoalkyl acrylates, amine salts of sulfoalkyl methacrylate, metal salts of acrylic and methacrylic acids, amine salts of acrylic and methacrylic acids; (2) a soluble copolymer of a quaternary ammonium salt monomer that is free of alkali metals and alkaline earth metals, said quaternary ammonium salt monomer being selected from the group consisting of:

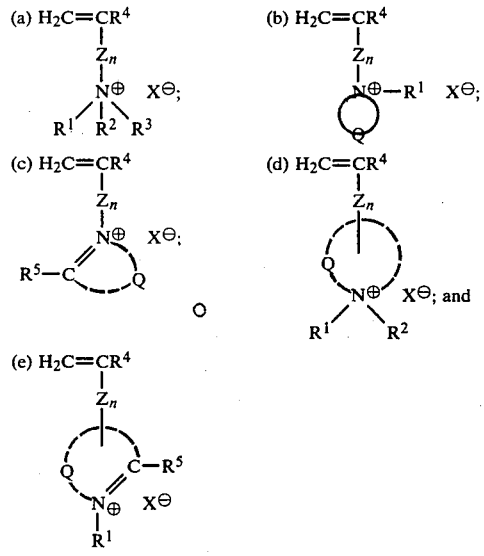

wherein:

$R^1$, $R^2$ and $R^3$ are alkyl or aryl radicals of 1 to 30 carbon atoms;

$R^4$ and $R^5$ are hydrogen or lower alkyl of 1 to 4 carbon atoms;

Q represents the atoms necessary to complete a 5 or 6-membered heterocyclic ring;

$X^-$ is an anion; and

Z is selected from the group consisting of $-R^6-$, $$\overset{O}{\overset{\|}{C}}-OR^6-,\ -\overset{O}{\overset{\|}{C}}-NH-R^6-,\ O-\overset{O}{\overset{\|}{C}}-R^6-\ \text{and}\ -CH_2O\overset{O}{\overset{\|}{C}}-R^6-,$$

where $R^6$ is alkylene, arylene or arylenealkylene of 1 to 20 carbon atoms, and n is 0 or 1; and (3) a halogenated hydrocarbon polymer.

7. A process of claim 6 for developing a latent electrostatic charge image, wherein said developer comprises from about 0.01 to about 5 weight percent of polar moiety-containing polymer, from about 0.01 to about 5 weight percent of quaternary ammonium salt-containing polymer, and from about 0.01 to about 5 weight percent halogenated polymer.

8. A process of claim 6 for developing a latent electrostatic charge image wherein said halogenated polymer is chlorinated polyethylene.

9. A process of claim 6 for developing a latent electrostatic charge image wherein said halogenated polymer is (poly(vinyl chloride-co-vinylidene chloride).

10. A process for developing a latent electrostatic charge image comprising forming said electrostatic charge image on an insulating electrographic element and contacting it with a liquid developer comprising an electrically insulating carrier liquid having dispersed therein poly(vinyltoluene-co-lauryl methacrylate-co-lithium methacrylate-co-methacrylic acid), poly(vinyltoluene-co-lauryl methacrylate-co-methacryloyloxyethyltrimethylammonium p-toluenesulfonate), and chlorinated polyethylene.

11. A process for developing a latent electrostatic charge image comprising forming said electrostatic charge image on an insulating electrographic element and developing said charge image by contacting it with a liquid developer comprising an electrically insulating paraffinic carrier liquid having dispersed therein poly(vinyltoluene-co-lauryl methacrylate-co-lithium methacrylate-co-methacrylic acid), poly(vinyltoluene-co-laurylmethacrylate-co-dimethyloctadecylvinylbenzylammonium chloride) and chlorinated polyethylene.

* * * * *